US005099218A

United States Patent [19]

Salisbury

[11] Patent Number: 5,099,218

[45] Date of Patent: Mar. 24, 1992

[54] BINARY FUSE DEVICE

[75] Inventor: Ian Salisbury, S. Devon, England

[73] Assignee: AVX Corporation, New York, N.Y.

[21] Appl. No.: 623,594

[22] Filed: Dec. 7, 1990

[51] Int. Cl.[5] ..... H01H 85/04

[52] U.S. Cl. ..... 337/296; 337/160; 337/290

[58] Field of Search ..... 337/290, 291, 292, 293, 337/294, 295, 296, 297, 160; 29/623

[56] References Cited

U.S. PATENT DOCUMENTS

| | | | |
|---|---|---|---|
| 1,068,341 | 7/1913 | Hope | 337/296 |
| 1,626.105 | 4/1927 | Sundt | 337/290 |
| 2,911,504 | 11/1959 | Cohn | 337/296 |
| 3,267,238 | 8/1966 | Arikawa et al. | 337/296 |

FOREIGN PATENT DOCUMENTS

| | | | |
|---|---|---|---|
| 0016467 | 10/1980 | European Pat. Off. | 29/623 |
| 96652 | 11/1938 | Fed. Rep. of Germany | 337/290 |

*Primary Examiner*—Harold Broome
*Attorney, Agent, or Firm*—Mark T. Basseches

[57] ABSTRACT

A binary electrical fuse is comprised of a core wire which is preferably relatively rigid, has a high ohmic resistance, and a high melt temperature. The core wire is clad with a metal of substantially less rigidity having a low ohmic resistivity, and low melt temperature, i.e. in the range of from about 230 degrees C. to 700 degrees C. The resistance of the core wire is at least about ten times the resistance of the cladding and preferably twenty or more times the resistance of the cladding. In the course of a fusing cycle the cladding metal will melt and pool, leaving the core wire as the sole conductor resulting in a rapid blow of the fuse due to the sudden high resistance load presented by the core wire.

3 Claims, 1 Drawing Sheet

BINARY FUSE DEVICE

BACKGROUND OF THE INVENTION

The present invention is directed to improvements in electrical fuses and relates more particularly to an improved miniature fuse device suitable for use as an element of an electronic component, such as a solid state (tantalum) capacitor, and having the following characteristics:

A. Low series resistance while intact;
B. High resistance (approximately 10 meg ohms) when open circuit;
C. Extremely small size;
D. Rapid acting;
E. High strength and stability for facilitating manufacture;
F. Low temperature initial activation followed by a short high temperature cycle.
G. Low manufacturing costs.

THE PRIOR ART

It is conventional practice to employ as a protective device a fuse mechanism which will interrupt a circuit when the electrical current flowing in the circuit exceeds a predetermined amount. It is likewise conventional to encompass fuse devices within an electronic component, such as a capacitor.

In particular, tantalum capacitors have been fabricated with internal fuses as a means of guarding against excessive current flow functioning to ignite the tantalum capacitor, which will burn like magnesium. Examples of such fused tantalum capacitors may be found in U.S. Pat. Nos. 4,720,772; 4,224,656 and others.

The fuse mechanisms heretofore known, and particularly the fuse mechanisms employed as integral components in electronic devices, have heretofore operated on one of two general principles.

A first type of known fuse is comprised of a thin wire formed of lead or lead alloys providing a low melt, low resistance conductor. When current in excess of a desired amount flows through the fusing wire the wire will melt at about 300 degrees C. depending upon the composition of the wire. The molten wire is intended to separate, leaving an open circuit.

The fuses of the low melt metal type are disadvantageous in many respects. Firstly, it is necessary to provide a considerable amount of empty space surrounding the fuse wire, so that the molten material will disperse. If such space is not provided the molten wire would continue to form a conductive path between the fuse terminals.

A second disadvantage of fuses of the low melt wire type is that the wire material is fragile, particularly where low value and hence small diameter wires are employed. The readily fractured nature of the wire and its low melting point make the remaining fabricating steps difficult to perform on an automated basis, particularly where the fuse is to be encompassed within a capacitor or the like.

Moreover, in view of the low melt characteristics of the fuse wire, it will be evident that the final use environment and all manufacturing steps must be maintained and carried out respectively at temperatures below the melt temperature of the fuse.

The second generic type of fuse construction is the so-called PYRO FUSE ®. Examples of such fuses may be found in U.S. Pat. Nos. 4,899,258 and 4,814,946. In general, fuses of this type employ an aluminum wire coated with palladium or copper and operate on the principle that when current flow through the wire reaches a critically high temperature, i.e. in the area of 660 degrees C., the materials alloy exothermically, which reaction ultimately results in ignition of the metals. The high temperature generated by the ignited metals may cause a local degradation of any encapsulating material.

Fuses of this exothermic alloying-ignition type engender a multiplicity of disadvantages, including the necessity to provide a surrounding cavity about the fuse wire for encompassing the oxygen necessary to effect combustion. In addition, the very high temperatures generated by the burning metals over the relatively protracted period of combustion necessitates significant separation of the metals from the tantalum capacitor, so as to prevent possible ignition of the tantalum.

Numerous variations of fuses of the two types described exist, it being understood, however, that all such variants are burdened with the described drawbacks to a greater or lesser degree.

SUMMARY OF THE INVENTION

The present invention may be summarized as directed to a binary fuse device operating on a totally different principle than fuses heretofore known. More particularly, the fuse of the instant invention is comprised of a core metal characterized in that it has high ohmic resistance and a high melt point. The core metal is coated with a low melt, low resistance metal which preferably does not "wet" to the core metal. Optionally, but preferably, the core metal may comprise a nickel-chromium alloy and the coating metal may comprise lead or a lead alloy.

When a fuse in accordance with the invention is subjected to currents exceeding the threshold amount, the fuse is activated to the "open" condition in a two stage sequence. Specifically, when current flow heats the composite fuse to a temperature above the temperature of the low melt surround metal, the molten metal retracts along the length of the core metal toward the preferably wettable terminals or pools at a central position along the core, leaving a conductor comprised solely of the high melt, high resistance core. Retraction of the surround metal is accompanied by a sudden increase in resistance of the fuse with a result that the core metal melts or vaporizes generating a high temperature flash of very short duration.

As will be apparent from the preceding description, the fuse in accordance with the present invention provides numerous advantages over the fuses of the two conventional types described. More specifically, the fuse does not require the use of expensive noble metals, such as palladium, and eliminates the necessity for handling the fragile solder type wires employed in fuses of the low melt type.

The fuse of the invention can be made to a very short length, since the low resistance, low melt cladding metal retracts from the central portion of the fuse in advance of opening of the circuit In addition, since the fuse opens on a two stage basis, the high heat generated by the central core material is sufficient to oxidize the metal of the cladding to preclude the possibility of a re-flow connection between the fuse terminals. Further, since the core wire generates a high temperature over a short duration, the fuse may be initially encapsulated, but will, upon activation, create a void in a degradable surround material in registry with the central core portion to further minimize the chances of re-flow connection between the fuse terminals. The fuse of the invention thus provides the advantage of low temperature activation (upon melting of the cladding metal), rapid resistance increase, followed by rapid activation at a high temperature and for a short duration of the central core metal.

The cladding material, generally lead or lead alloy, is readily connectable to terminals, as by soldering, yet the fuse wire is far more durable than conventional solder fuses due to the strength of the core metal.

Accordingly, it is an object of the invention to provide an improved fuse device. More particularly, it is an object of the invention to provide a binary fuse device comprised of a core wire of high melt, high resistance metal and a cladding of low melt, low resistance metal which preferably does not "wet" to the high resistance core.

DETAILED DESCRIPTION OF THE DRAWINGS

Figure 1:
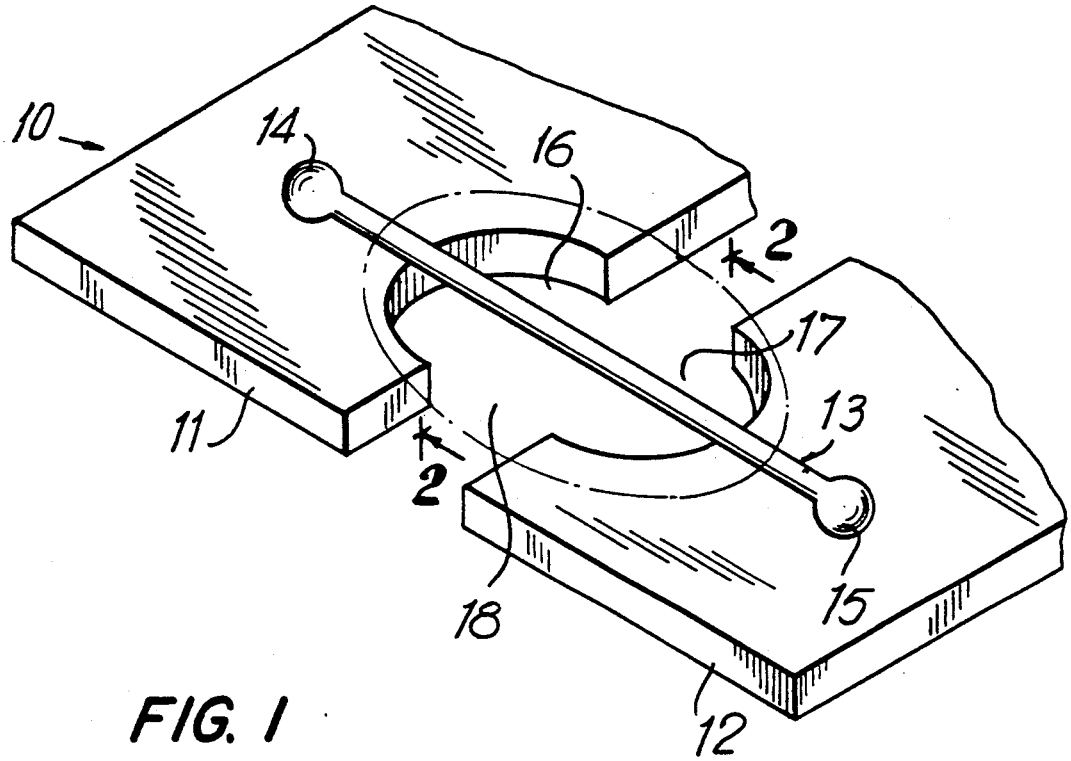
FIG. 1 is a fragmentary perspective view of a fuse in accordance with the invention as affixed to a lead frame.

Referring now to the drawings, there is shown in FIG. 1 a lead frame device 10 including a first section 11 and a second section 12, electrically isolated from section 11 except via a fuse wire 13, the distal ends 14–15 of which are connected to the lead frame sections 11–12 respectively. The connections 14–15 may be effected by soldering, welding, crimping or the like. Also, while the fuse member 13 is illustrated as employed in conjunction with a lead frame, it will be readily appreciated by those skilled in the art that the fuse may be mounted in any of a number of alternate configurations and may form an inclusion within an encapsulated electronic component, such as a capacitor.

Optionally, but preferably, the lead frame sections 11–12 include cutout portions 16–17 respectively, spanned by a central portion 18 of the fuse member 13.

Figure 2:
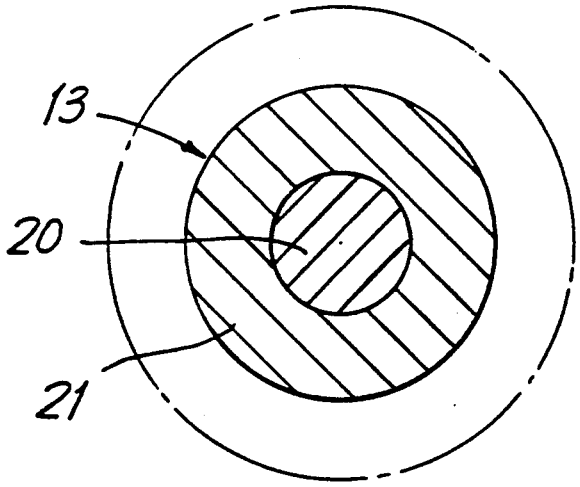
FIG. 2 is a magnified transverse section taken on line 2—2 of FIG. 1.

As shown in FIG. 2, the binary fuse 13 is comprised of a central core metal 20, which is formed of a high resistance, high melt metal, illustratively a nickel, chromium alloy (80% Ni, 20% Cr), commonly known as nichrome. The core 20 is encapsulated within a cladding metal 21, formed of a low resistance, low melt metal, illustratively lead. The nichrome wire is clad utilizing a standard lead plating bath, adhesion of the lead being facilitated by first forming a micro-thin precoating of nickel over the nichrome.

By way of example and without limitation, a wire design for a fuse which will blow at 1.5 amps may be formed utilizing a nichrome wire having a thickness of 25 microns, overcoated with a lead coating of 23 micron thickness. The described fuse may have an overall length of 0.06 cm and a resistance of 0.08 ohms. In the described fuse, the nichrome wire resistance is 1.3 ohms, whereas the resistance of the lead cladding is 0.09 ohms.

There is illustrated in Table I below, details for a number of fuse values utilizing nichrome core wire and lead cladding. This Table is supplied by way of illustration only and it will be readily recognized by those skilled in the art that the fuse characteristics, such as fusing amps, fusing speed etc., may be tailored to a variety of desired values by modifying the dimensional and compositional characteristics of the core and cladding components.

TABLE I

| Fusing Amps | Fuse Length (CM) | Fuse Resistance (ohms) | Nichrome Wire Resistance (ohms) | Lead Resistance (ohms) |
|---|---|---|---|---|
| 1 | 0.06 | 0.19 | 1.3 | 0.22 |
| 1.5 | 0.06 | 0.08 | 1.3 | 0.09 |
| 2.0 | 0.06 | 0.047 | 1.3 | 0.049 |
| 2.5 | 0.06 | 0.03 | 1.3 | 0.031 |

While a nickel, chromium alloy is, at present, considered to be a preferred core material, it will be readily recognized that a multiplicity of other metals and metal alloys may be utilized instead of nichrome. By way of example and without limitation, successful results have been achieved utilizing alloys of chromium, aluminum and iron; nickel, chromium, aluminum and silicon; nickel, manganese and silicon, etc. Similarly, alternate cladding metals and their alloys, which have been successfully employed, include tin, zinc, gold-germanium, lead-indium, lead-antimony, lead-tin, lead-silver and zinc-aluminum.

The cladding metal should melt at a temperature of at least about 300 degrees C. lower than the melt temperature of the core wire, and ideally should melt at 900 degrees C. or more lower than the melt temperature of the core. Desirably, the cladding metal should melt at temperatures in the range of from about 230 degrees C. to 450 degrees C., and not higher than 700 degrees C. The melt temperature of the core wire should be at least 1000 degrees C. or higher.

It is possible to increase the fusing speed by increasing the diameter of the core wire, while maintaining the same overall fuse resistance. Obviously, if a slower fusing speed is desired the ratio must be changed in an opposite manner. As previously noted, it is often desirable to encapsulate the fuse components in a polymeric material, which, when subjected to the temperatures of melt of the core wire, will degrade to provide a space or void surrounding the position formerly occupied by the fusible wire. By way of example and without limitation, a recommended encapsulating material is silicon resin, which breaks down below the fusing temperature of the core wire and gives off a gas to create a void surrounding the position formerly occupied by the fuse wire.

Fuses in accordance with the present invention have shown an open circuit resistance of greater than 30 meg ohms with a voltage breakdown after fuse blow of 300 volts DC.

When the fuse is subjected to excess current there is observed an initial melt and partial retraction or pooling, generally toward the terminals of the cladding material followed by a rapid melt and/or volatilization of the exposed core wire. The retraction of the molten cladding permits of a very short fuse length without sacrifice of high open circuit resistance.

As will be appreciated from the foregoing, there is provided in accordance with the invention a fuse device characterized by ease of handling of the fusible material, low cost, rapid fuse blow, high open circuit resistance and low cost. Only an extremely short length of fuse wire is required, and by virtue of the short duration, high temperature final fusing action, the fuse permits local degradation of encapsulating material without fear of initiating combustion, as is the case with fuses of the PYRO FUSE type.

As will be apparent to those skilled in the art and familiarized with the instant disclosure, numerous variations in details of construction, dimension and composition of the fuse components may be made without departure from the spirit of the inventions.

Accordingly, the invention is to be broadly construed within the scope of the appended claims.

I claim:

1. In a rapid acting miniature binary electric fuse assembly adapted to provide a high resistance open circuit path following fuse activation and including a fuse element comprising a core wire formed of a first metal and a cladding of a second metal encompassing said core wire, the improvement which comprises (a) the ohmic resistance of said core wire being at least about ten times the ohmic resistance of said cladding, (b) said first metal having a melt point of at least about 1000 degrees C. and at least about 300 degrees C. higher than the melt point of said second metal, (c) said first metal being non-wettable by said second metal whereby said cladding pools upon melting, and (d) said fuse element being encapsulated within a polymeric material subject to thermal degradation at a temperature below the melt temperature of said core wire to thereby create an enlarged void area as a result of thermal degradation of said polymeric material responsive to activation of said fuse element.

2. A fuse assembly in accordance with claim 1, wherein said first metal comprises nichrome.

3. A fuse assembly in accordance with claim 1, wherein said polymeric material comprises a silicone composition which emits a gas when heated to a temperature below the melt temperature of said first metal to thereby increase said enlarged void in the area surrounding the position formerly occupied by said fuse element.

* * * * *